US008403535B1

(12) United States Patent
Keith, Jr.

(10) Patent No.: US 8,403,535 B1
(45) Date of Patent: Mar. 26, 2013

(54) LIGHTING SYSTEM

(76) Inventor: Clarence E. Keith, Jr., Chicago, IL (US)

( * ) Notice: Subject to any disclaimer, the term of this patent is extended or adjusted under 35 U.S.C. 154(b) by 266 days.

(21) Appl. No.: 12/932,094

(22) Filed: Feb. 17, 2011

Related U.S. Application Data

(60) Provisional application No. 61/338,364, filed on Feb. 18, 2010.

(51) Int. Cl.
*F21S 4/00* (2006.01)

(52) U.S. Cl. ..... 362/249.16; 362/249.13; 362/249.02; 362/249.11

(58) Field of Classification Search ..... 362/249.16, 362/249.13, 249.11, 249.02
See application file for complete search history.

(56) References Cited

U.S. PATENT DOCUMENTS 5,161,882 A * 11/1992 Garrett ..... 362/249.01
5,513,081 A 4/1996 Byers
5,893,628 A 4/1999 Byers
7,198,153 B2 4/2007 Shaffer
7,703,941 B2 * 4/2010 Lee ..... 362/219
2010/0118554 A1 * 5/2010 Kraus et al. ..... 362/396

* cited by examiner

*Primary Examiner* — Evan Dzierzynski
(74) *Attorney, Agent, or Firm* — Emery L. Tracy

(57) ABSTRACT

A lighting system for hanging outdoor holiday lights from the eaves of a building is provided. The lighting system comprises a plurality of spaced mounting clips securable to the eaves of the building. At least one base mount is positionable within the mounting clips with the at least one base mount having a top surface, a bottom surface, a first end, and a second end. A plurality of spaced sockets are formed along the top surface of the at least one base mount with each spaced socket sized and shaped for receiving a holiday light. Electrical wiring is mounted along the bottom surface of the at least one base mount with the electrical wiring electrically connected to each of the sockets for illuminating the holiday light therein. A securing mechanism releasably securing adjacent base mounts together. A power connection is mounted between adjacent base mounts and electrically connecting adjacent base mounts together. Upon providing power to the electrical wiring, the lights in the base mounts illuminate.

20 Claims, 2 Drawing Sheets

LIGHTING SYSTEM

The present application claims the benefit of priority of provisional patent application Ser. No. 61/338,364, filed on Feb. 18, 2010, entitled "Lighting System".

BACKGROUND OF THE INVENTION

1. Field of the Invention

This invention relates generally to a lighting system and, more particularly, the invention relates to a lighting system for safely facilitating the hanging of outdoor holiday lights.

2. Description of the Prior Art

Although striking to look at, strung lights are not without their drawbacks. Specifically, hanging strands of outdoor holiday lights can be a difficult task. Standing atop a tall ladder and attempting to secure the lights to the trim of one's roof can be both awkward and exhausting. Trying to wrap the light strands around a home's rainspouts or trim, only to have the lights slip and hang unattractively takes the fun out of decorating. Because getting the lights to stay in place can be so difficult, this part of decorating can take a great amount of time.

SUMMARY

The present invention is a lighting system for hanging outdoor holiday lights from the eaves of a building. The lighting system comprises a plurality of spaced mounting clips securable to the eaves of the building. At least one base mount is positionable within the mounting clips with the at least one base mount having a top surface, a bottom surface, a first end, and a second end. A plurality of spaced sockets are formed along the top surface of the at least one base mount with each spaced socket sized and shaped for receiving a holiday light. Electrical wiring is mounted along the bottom surface of the at least one base mount with the electrical wiring electrically connected to each of the sockets for illuminating the holiday light therein. A securing mechanism releasably securing adjacent base mounts together. A power connection is mounted between adjacent base mounts and electrically connecting adjacent base mounts together. Upon providing power to the electrical wiring, the lights in the base mounts illuminate.

In addition, the present invention includes a lighting system for hanging outdoor holiday lights from the eaves of a building. The lighting system comprises a plurality of spaced mounting clips with each mounting clip having a trough. Fastening means secure the mounting clips to the eaves of the building. At least one base mount is positionable within troughs of the mounting clips with the at least one base mount having a top surface, a bottom surface, a first end, and a second end. A plurality of spaced sockets are formed along the top surface of the at least one base mount with each spaced socket sized and shaped for receiving a holiday light and each of the sockets having a first opening for receiving a large bulb and a second opening for receiving a small bulb. The first opening has a diameter larger than a diameter of the second opening. Electrical wiring is mounted along the bottom surface of the at least one base mount with the electrical wiring electrically connected to each of the sockets for illuminating the holiday light therein. Securing means releasably secure adjacent base mounts together with the securing means allowing each base mount to rotate relative to an adjacent base mount. A power connection is mounted between adjacent base mounts and electrically connecting adjacent base mounts together. The mounting clips position the at least one base mount a predetermined distance away from the eaves of the house. Upon providing power to the electrical wiring, the lights in the base mounts illuminate.

The present invention further includes a method for hanging outdoor holiday lights from the eaves of a building. The method comprises securing a plurality of spaced mounting clips to the eaves of the building, positioning at least one base mount within the mounting clips with the at least one base mount having a top surface, a bottom surface, a first end, and a second end, spacing a plurality of spaced sockets along the top surface of the at least one base mount, mounting electrical wiring along the bottom surface of the at least one base mount, electrically connecting the electrical wiring electrically to each of the sockets, releasably securing adjacent base mounts together, mounting a power connection between adjacent base mounts, electrically connecting adjacent base mounts together, inserting holiday lights in the sockets, providing power to the electrical wiring, and illuminating the holiday lights.

DETAILED DESCRIPTION OF THE PREFERRED EMBODIMENTS

Figure 1:
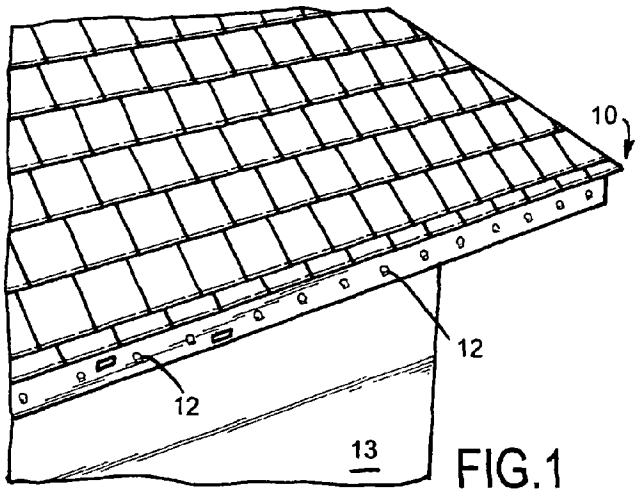
FIG. 1 is a perspective view illustrating a lighting system, constructed in accordance with the present invention.
Figure 3:
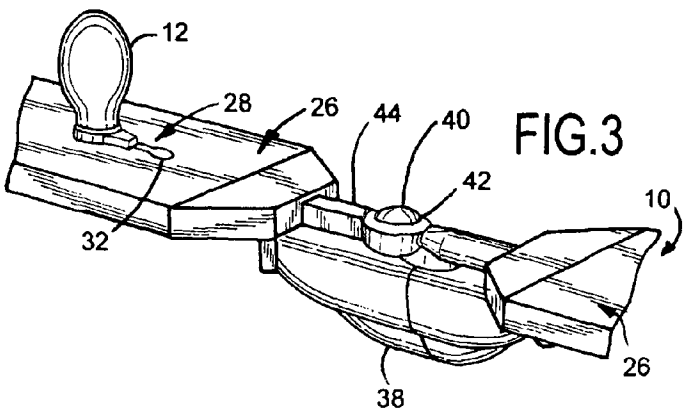
FIG. 3 is a perspective view illustrating the lighting system of FIG. 1, constructed in accordance with the present invention, with a large lighted releasably secured therein and adjacent base mounts releasably secured together.
Figure 2:
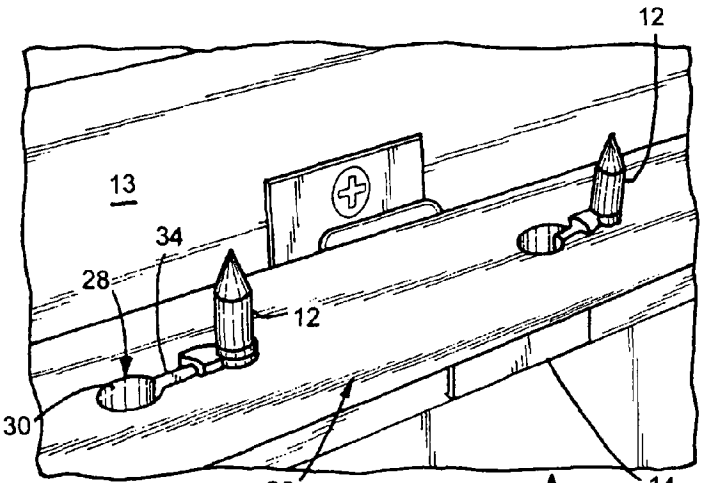
FIG. 2 is another perspective view illustrating the lighting system of FIG. 1, constructed in accordance with the present invention, with a small lighted releasably secured therein.
Figure 4:
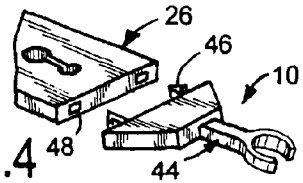
FIG. 4 is a perspective view illustrating replaceable fasteners of the lighting system of FIG. 1, constructed in accordance with the present invention, for releasably securing adjacent base mounts together.
Figure 5:
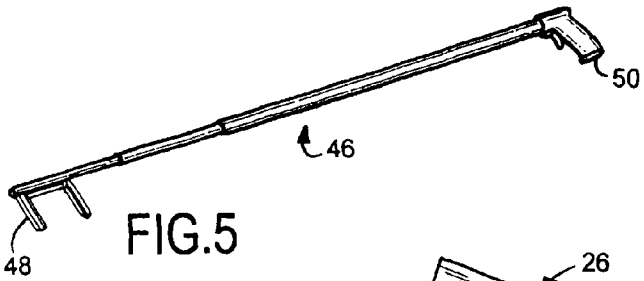
FIG. 5 is a perspective view illustrating an installation pole for use with the lighting system of FIG. 1, constructed in accordance with the present invention.
Figure 6:
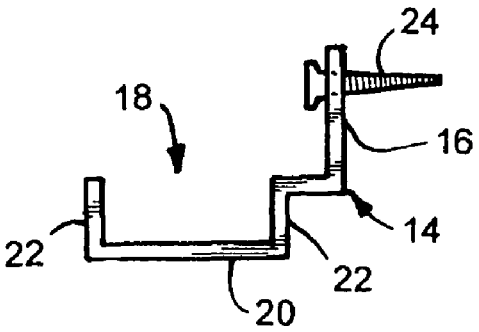
FIG. 6 is an elevational side view illustrating a mounting clip of the lighting system of FIG. 1, constructed in accordance with the present invention.
Figure 7:
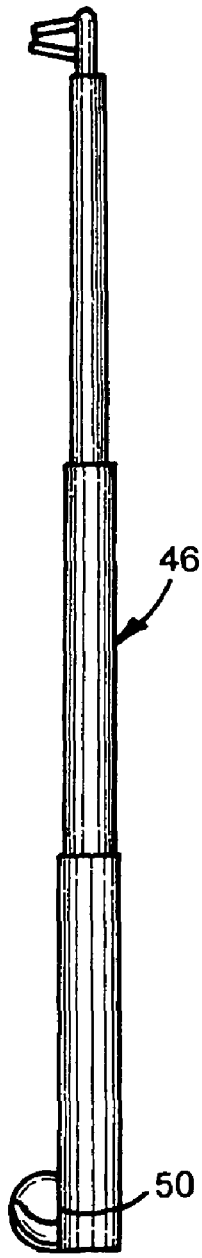
FIG. 7 is an elevational side view illustrating an embodiment of the installation pole for use with the lighting system of FIG. 1, constructed in accordance with the present invention.

As illustrated in FIGS. 1-7, the present invention is a lighting system, indicated generally at 10, for safely facilitating the hanging of outdoor holiday lights 12. The lighting system 10 of the present invention provides users a simple and efficient means of securing festive holiday lights 12 to the exterior of their home 13. In addition, the lighting system 10 provides users all of the components necessary to decorate their home with beautiful illuminated lights 12, quickly and with ease.

The lighting system 10 of the present invention includes a plurality of spaced mounting clips 14 secured along the eaves or trim of a home 13. The mounting clips 14 preferably have a vertical mounting wall 16 and a receiving trough 18 having a horizontal base wall 20 and two vertical support walls 22, one spaced on one edge of the horizontal base wall 20 and the other spaced on the opposite edge of the horizontal base wall 20. The vertical mounting wall 16 is positionable against the house eave and secured therein using a fastening mechanism.

In a preferred embodiment, the fastening mechanism is at least one screw 24 although using other types of fastening mechanisms is within the scope of the present invention. The mounting clips 14 preferably releasably hold a series of base mounts 26 a predetermined distance away from the eaves of the house 13.

In addition, the lighting system 10 of the present invention includes at least one base mount 26 positionable within the receiving troughs 18 of the mounting clips 14. Each base mount has a top surface, a bottom surface, a first end, and a second end. Each base mount 26 is preferably constructed in three (3') feet, four (4') feet, and/or six (6') feet lengths and measures approximately one and one-eighth (1⅛") inches in width although constructing the base mounts 26 in different lengths is within the scope of the present invention.

Spaced at four (4") inch intervals along the top surface of each base mount 26 of the lighting system 10 of the present invention is a plurality of sockets 28 inside of which the user secures the individual holiday lights 12. In a preferred embodiment, each of the sockets 28 has a first opening 30 for receiving a large bulb and a second opening 32 for receiving a small bulb. The first opening 30 has a diameter larger than a diameter of the second opening 32. A slot 34 extends between the first opening 30 and the second opening 32 for receiving a retainer clip 36. In practice, the retainer clip 36 is slidable within the slot 34 alternatingly against either the large bulb in the first opening 30 or the small bulb 3 in the second opening 32. In a preferred embodiment, the retainer clip 36 is resilient and held within the slot 34 and against either the large bulb or the small bulb by friction. The retainer clip 36 further assists in releasably securing the holiday lights 12 within the base mounts 26.

The lighting system 10 of the present invention further includes appropriate electrical wiring along the bottom surface of each of the base mounts 26 and connected to the sockets 28 for illuminating the holiday lights 12 when power is supplied to the electrical wiring. In an embodiment of the present invention, the electrical wiring can be positioned within a recess formed in the bottom surface of each of the base mounts 26 thereby effectively "hiding" the electrical wiring from view. Each base mount 26 is electrically connected to each adjacent base mount 26 by a power connection 38, as will be described in further detail below.

Furthermore, the lighting system 10 of the present invention includes securing means for releasably securing adjacent base mounts together. In a preferred embodiment, the securing means includes a ball and socket connection 40. The ball and socket connection 40 allows user to adjust the positioning of the lighting system 10 to conform to potential irregularities in the eaves by moving each base mount 26 relative to any adjacent base mount 26.

The ball and socket connection 40 of the lighting system 10 of the present invention includes a ball portion 42 and a socket portion 44. Each ball portion 42 and each socket portion 44 has a pair of clips 46 receivable within apertures 48 formed in the first end and the second end of each of the base mounts 26. Each clip 46 has a protrusion for releasably securing the clip 46 within the appropriate aperture 48. In practice, the ball portion 42 of the ball and socket connection 40 is attached to the first end of the base mount 26 and the socket portion 44 of the ball and socket 40 is attached to the second end of the adjacent base mount 26.

A power connection 38 of the lighting system 10 of the present invention, as briefly mentioned above, is mounted between two adjacent base mounts 26 and electrically connects adjacent base mounts 26 together. The power mount 38 is preferably mounted beneath the ball and socket connection 40 so as not to interfere with the operation of the securing means.

The lighting system 10 of the present invention is preferably manufactured primarily of lightweight and weather resistant plastic material although constructing the lighting system 10 from other materials is within the scope of the present invention.

Additionally, the lighting system 10 of the present invention includes an installation pole 46 for use in securing the lights 12 within the sockets 28 of the base mounts 26. Preferably constructed of durable plastic tubing, the installation pole 46 of the lighting system 10 is an extendable pole on the distal end of which a specially designed hanging tool 48 is integrally attached. A lightweight unit, the installation pole 46 is comprised of telescoping components, measuring mere feet when compacted and expanding up to eighteen (18') feet or more in length when fully extended. A series of adjustable tension screws or comparable fittings are positioned along each telescoping section of the installation pole 46, allowing the user to releasably "lock" the desired length in place during use. To facilitate the hanging of the lights 12, the distal end of the installation pole 46 features a claw-like grip 48 designed to cradle the lights 12 as they are slid into the sockets 28 on the base mounts 26. The grip 48 is easily opened and closed by way of a trigger-operated handgrip 50, located on the proximal end of the installation pole 46.

The manner of use of the lighting system 10 of the present invention will now be described. It will be understood by those skilled in the art that the manner of use of the lighting system 10 described herein is merely one method of use and other methods of use of the lighting system 10 are within the scope of the present invention.

Use of the lighting system 10 of the present invention is fairly simple and straightforward. First, according to easily followed package instructions, the user mounts the mounting clips 14 along their roofline. A one-time installation, the decorative mounting clips 14 are designed to be left in place for use throughout the year, from one holiday season to the next. Once the mounting clips 14 are secured in place, the user positions the base mounts 26 within the receiving troughs 18 of the mounting clips 14, connects each adjacent base mount 26 together using the ball and socket connection 40, and electrically connects each adjacent base mount 26 together using the power connection 38. Next, the lights 12 are positioned with the sockets 28 utilizing the telescoping installation pole 46. If desired, retainer clips 36 can be slid against the lights 12 to further secure them in place. An extension cord can be attached to the end on the first base mount 26 and connected to a power supply for supplying power to the lighting system 10. At the end of the holiday season, the lights 12 can be easily removed from the base mounts 26 by reversing the installation process. The lighting system 10 can then be conveniently stored, if desired, along with other holiday finery, until the next holiday season.

There are many benefits and advantages associated with the lighting system 10 of the present invention. Foremost, as mentioned above, the lighting system 10 provides users a simple and efficient means of securing festive holiday lights 12 to the exterior of their home. A cleverly designed system comprised of installed base mounts 26 holding the lights 12 in place, and a fully adjustable installation pole 46, the lighting system 10 provides users all of the components necessary to decorate their home 13 with beautiful illuminated lights 12, quickly and with ease. Easily hanging individual base mounts 26 to the mounting clips 14, the lighting system 10 eliminates the need to repeatedly climb up and down a ladder, simply in order to secure holiday lights 12 in place. As such, use of the lighting system 10 enables users to hang their holiday lights 12 while safely standing on the ground below and without exerting extreme physical effort in order to do so. Another important advantage is that the lighting system 10 enables users to hang their lights 12 in a fraction of the time required by other methods. A simple application, users will appreciate the ease at which the lighting system 10 can be utilized. The lighting system 10 also makes the task of removing the lights 12 after the holidays simple and pleasant. As such, users can easily adorn their home with decorative lights 12 for holidays such as Christmas, Halloween, Independence Day, and Easter, to name a few options.

The lighting system 10 of the present invention offers users a convenient means of decorating the exterior of their home with dazzling outdoor lights 12 for the holiday season. Simple to use, the lighting system 10 easily facilitates stringing holiday lights 12 in an orderly fashion, allowing for an even and aesthetically pleasing distribution of lights 12.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A lighting system for hanging outdoor holiday lights from the eaves of a building, the lighting system comprising:

a plurality of spaced mounting clips securable to the eaves of the building;

at least one base mount positionable within the mounting clips, the at least one base mount having a top surface, a bottom surface, a first end, and a second end;

a plurality of spaced sockets formed along the top surface of the at least one base mount, each spaced socket sized and shaped for receiving a holiday light;

electrical wiring mounted along the bottom surface of the at least one base mount, the electrical wiring electrically connected to each of the sockets for illuminating the holiday light therein;

securing means for releasably securing adjacent base mounts together; and a power connection mounted between adjacent base mounts and electrically connecting adjacent base mounts together;

wherein upon providing power to the electrical wiring, the lights in the base mounts illuminate.

2. The lighting system of claim 1 wherein each of the mounting clips have a vertical mounting wall and a receiving trough having a horizontal base wall and two vertical support walls, one spaced on one edge of the horizontal base wall and the other spaced on the opposite edge of the horizontal base wall, the vertical mounting wall positionable against the eaves of the building, the at least one base mount resting within the receiving troughs, and further comprising:

a fastening mechanism for holding the vertical mounting wall against the eaves of the building.

3. The lighting system of claim 1 wherein the mounting clips position the at least one base mount a predetermined distance away from the eaves of the house.

4. The lighting system of claim 1 wherein each of the sockets has a first opening for receiving a large bulb and a second opening for receiving a small bulb, the first opening having a diameter larger than a diameter of the second opening.

5. The lighting system of claim 4 and further comprising:

a slot extending between the first opening and the second opening for receiving a retainer clip, the retainer clip slidable within the slot alternatingly against either the large bulb in the first opening or the small bulb in the second opening;

wherein the retainer clip is resilient and held within the slot and against either the large bulb or the small bulb by friction for assisting in releasably securing the holiday lights within the base mounts.

6. The lighting system of claim 1 wherein the electrical wiring is positioned within a recess formed in the bottom surface of the at least one base mount.

7. The lighting system of claim 1 wherein the securing means is a ball and socket connection allowing adjustment of the positioning to conform to irregularities in the eaves of the building, the ball and socket connection having a ball portion connected to the first end of a base mount and a socket portion connected to the second end of an adjacent base mount.

8. The lighting system of claim 7 wherein each ball portion and each socket portion have a pair of clips receivable within apertures formed in the first end and the second end of each of the base mounts, each clip having a protrusion for releasably securing the clip within the appropriate aperture.

9. The lighting system of claim 1 and further comprising:

an installation pole for securing lights within the sockets of the at least one base mount, the installation pole being an extendable pole having a claw-like grip on one end and a trigger on the other end for operating the grip.

10. A lighting system for hanging outdoor holiday lights from the eaves of a building, the lighting system comprising:

a plurality of spaced mounting clips, each mounting clip having a trough;

fastening means for securing the mounting clips to the eaves of the building;

at least one base mount positionable within troughs of the mounting clips, the at least one base mount having a top surface, a bottom surface, a first end, and a second end;

a plurality of spaced sockets formed along the top surface of the at least one base mount, each spaced socket sized and shaped for receiving a holiday light, each of the sockets having a first opening for receiving a large bulb and a second opening for receiving a small bulb, the first opening having a diameter larger than a diameter of the second opening;

electrical wiring mounted along the bottom surface of the at least one base mount, the electrical wiring electrically connected to each of the sockets for illuminating the holiday light therein;

securing means for releasably securing adjacent base mounts together, the securing means allowing each base mount to rotate relative to an adjacent base mount; and a power connection mounted between adjacent base mounts and electrically connecting adjacent base mounts together;

wherein the mounting clips position the at least one base mount a predetermined distance away from the eaves of the house; and wherein upon providing power to the electrical wiring, the lights in the base mounts illuminate.

11. The lighting system of claim 10 and further comprising:

a slot extending between the first opening and the second opening for receiving a retainer clip, the retainer clip slidable within the slot alternatingly against either the large bulb in the first opening or the small bulb in the second opening;

wherein the retainer clip is resilient and held within the slot and against either the large bulb or the small bulb by friction for assisting in releasably securing the holiday lights within the base mounts.

12. The lighting system of claim 10 wherein the electrical wiring is positioned within a recess formed in the bottom surface of the at least one base mount.

13. The lighting system of claim 10 wherein the securing means is a ball and socket connection allowing adjustment of the positioning to conform to irregularities in the eaves of the building, the ball and socket connection having a ball portion connected to the first end of a base mount and a socket portion connected to the second end of an adjacent base mount.

14. The lighting system of claim 13 wherein each ball portion and each socket portion have a pair of clips receivable within apertures formed in the first end and the second end of each of the base mounts, each clip having a protrusion for releasably securing the clip within the appropriate aperture.

15. The lighting system of claim 10 and further comprising:

an installation pole for securing lights within the sockets of the at least one base mount, the installation pole being an extendable pole having a claw-like grip on one end and a trigger on the other end for operating the grip.

16. A method for hanging outdoor holiday lights from the eaves of a building, the method comprising:

securing a plurality of spaced mounting clips to the eaves of the building;

positioning at least one base mount within the mounting clips, the at least one base mount having a top surface, a bottom surface, a first end, and a second end;

spacing a plurality of spaced sockets along the top surface of the at least one base mount;

mounting electrical wiring along the bottom surface of the at least one base mount;

electrically connecting the electrical wiring electrically to each of the sockets;

releasably securing adjacent base mounts together;

mounting a power connection between adjacent base mounts;

electrically connecting adjacent base mounts together;

inserting holiday lights in the sockets;

providing power to the electrical wiring; and illuminating the holiday lights.

17. The method of claim 16 and further comprising:

positioning the at least one base mount a predetermined distance away from the eaves of the house.

18. The method of claim 16 wherein each of the sockets has a first opening for receiving a large bulb and a second opening for receiving a small bulb, the first opening having a diameter larger than a diameter of the second opening.

19. The method of claim 18 and further comprising:

extending a slot between the first opening and the second opening;

positioning a retainer clip with the slot;

alternatingly sliding the retainer clip within the slot against either the large bulb in the first opening or the small bulb in the second opening; and holding the retainer clip within the slot and against either the large bulb or the small bulb by friction for assisting in releasably securing the holiday lights within the base mounts.

20. The method of claim 16 and further comprising:

providing an installation pole for securing lights within the sockets of the at least one base mount, the installation pole being an extendable pole having a claw-like grip on one end and a trigger on the other end for operating the grip.

* * * * *